US012173727B2

(12) United States Patent
Mackey et al.

(10) Patent No.: US 12,173,727 B2
(45) Date of Patent: Dec. 24, 2024

(54) REGENERATIVE PUMP WITH VARIABLE REGENERATIVE FLOW

(71) Applicant: Eaton Intelligent Power Limited, Dublin (IE)

(72) Inventors: Cody Mackey, Fairport Harbor, OH (US); Martin Augustine Clements, Loveland, OH (US); Matthew Reinhardt, Painesville, OH (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 18 days.

(21) Appl. No.: 17/856,113

(22) Filed: Jul. 1, 2022

(65) Prior Publication Data

US 2023/0011740 A1 Jan. 12, 2023

Related U.S. Application Data

(60) Provisional application No. 63/219,243, filed on Jul. 7, 2021.

(51) Int. Cl.

| | |
|---|---|
| ***F04D 5/00*** | (2006.01) |
| ***F04D 29/24*** | (2006.01) |
| ***F04D 29/46*** | (2006.01) |

(52) U.S. Cl.

CPC ..... *F04D 5/008* (2013.01); *F04D 29/24* (2013.01); *F04D 29/46* (2013.01)

(58) Field of Classification Search

CPC ..... F04D 5/008; F04D 26/24; F04D 26/46; F04D 15/0077; F04D 15/005; F04D 15/0033; F04D 15/0038

See application file for complete search history.

(56) References Cited

U.S. PATENT DOCUMENTS 2,940,394 A * 6/1960 Mosure ..... F04D 15/005 415/55.1
3,257,955 A * 6/1966 Worst ..... F04D 15/005 415/146
3,405,644 A * 10/1968 Thomas ..... F04D 15/005 415/55.2

(Continued)

FOREIGN PATENT DOCUMENTS

DE 4444704 A1 * 6/1996 ..... F02M 69/02

OTHER PUBLICATIONS

Maennchen et al. DE 44 44 704 _ English Machine Translation _ Espacenet (Year: 1996).*

*Primary Examiner* — David E Sosnowski
*Assistant Examiner* — Wayne A Lambert
(74) *Attorney, Agent, or Firm* — Merchant & Gould P.C.

(57) ABSTRACT

A regenerative pump includes a housing defining a cavity having a fluid inlet arrangement and fluid outlet arrangement, and a channel having an open volume extending between the fluid inlet arrangement and the fluid outlet arrangement. A rotatable shaft extends into the housing. An impeller is mounted to the shaft within the cavity and has a plurality of vanes spaced circumferentially around the axis and opening into the channel. An arm arrangement at least partially defines walls of the channel. The arm arrangement is radially movable to vary the volume of the channel. Enlarging the volume of the channel inhibits regenerative circulatory flow during pumping and limits the pressure generated.

15 Claims, 7 Drawing Sheets

(56) References Cited

U.S. PATENT DOCUMENTS 3,558,236 A * 1/1971 Bylsma ..... F04D 5/002 415/55.1
3,576,375 A * 4/1971 Jackson ..... F04D 29/20 415/18
3,804,547 A * 4/1974 Hagemann ..... F04D 5/002 415/55.2
4,194,360 A * 3/1980 Stieger ..... F02B 63/06 415/55.2
4,408,952 A * 10/1983 Schweinfurter ..... F04D 5/005 415/55.1
4,938,659 A * 7/1990 Bassler ..... F04D 29/188 415/55.1
4,948,344 A 8/1990 Cygnor
5,011,367 A * 4/1991 Yoshida ..... F04D 5/007 415/55.1
5,257,916 A * 11/1993 Tuckey ..... F02M 37/048 417/423.4
5,299,908 A * 4/1994 Robbie ..... F04D 5/002 415/55.1
5,372,475 A * 12/1994 Kato ..... F02M 37/048 415/55.1
5,407,318 A * 4/1995 Ito ..... F04D 5/002 415/55.1
5,409,357 A * 4/1995 Yu ..... F04D 5/002 415/55.1
5,513,950 A * 5/1996 Yu ..... F04D 29/188 415/55.1
5,599,163 A 2/1997 Heath et al.
5,601,398 A * 2/1997 Treiber ..... F04D 5/002 415/55.1
5,772,393 A * 6/1998 Nakamura ..... F04D 5/002 415/55.2
5,819,524 A * 10/1998 Bosley ..... F01D 5/04 415/55.1
5,904,468 A * 5/1999 Dobler ..... F02M 37/048 415/55.1
5,921,746 A * 7/1999 Yu ..... F04D 7/04 415/55.1
6,113,363 A * 9/2000 Talaski ..... F02M 37/08 415/55.1
6,152,686 A * 11/2000 Neidhard ..... F02M 37/048 415/55.1
6,287,093 B1 * 9/2001 Huebel ..... F04D 5/002 415/52.1
6,527,505 B2 * 3/2003 Yu ..... F04D 5/007 415/55.1
6,676,367 B2 1/2004 Moss
6,688,844 B2 * 2/2004 Yu ..... F04D 29/188 415/55.1
6,846,155 B2 * 1/2005 Takami ..... F04D 29/188 415/55.1
7,217,083 B2 * 5/2007 Yasuda ..... F04D 23/008 415/55.1
7,455,496 B2 * 11/2008 Motojima ..... F04D 29/188 415/55.1
2003/0068220 A1 * 4/2003 Yu ..... F04D 5/007 415/55.1
2019/0277233 A1 9/2019 Clements
2021/0277901 A1 * 9/2021 Mackey ..... F04D 29/62

* cited by examiner

REGENERATIVE PUMP WITH VARIABLE REGENERATIVE FLOW

RELATED APPLICATIONS

This application claims the benefit of U.S. Provisional Patent Application No. 63/219,243, filed Jul. 7, 2021, which is incorporated by reference herein in its entirety.

TECHNICAL FIELD

This disclosure relates to pumps and more particularly, regenerative pumps, including methods of use.

BACKGROUND

Pumps, including regenerative pumps, are useful in many different types of systems. While one example includes aircraft engine fuel systems, this disclosure relates to a regenerative pump that can be used in a variety of systems.

In some example systems, a regenerative pump can be used to allow pressure to ramp up quickly, which is useful. However, if the pressure is allowed to increase too much, the system could sustain damage from over-pressurization. Improvements are desirable.

SUMMARY

A regenerative pump is provided that improves the prior art.

In one concept, a regenerative pump is provided comprising: a housing defining a cavity having a fluid inlet arrangement and fluid outlet arrangement, and a channel having an open volume extending between the fluid inlet arrangement and the fluid outlet arrangement; a rotatable shaft extending into the housing having a longitudinal axis; an impeller mounted to the shaft within the cavity; the impeller having a plurality of vanes spaced circumferentially around the axis and opening into the channel; and an arm arrangement at least partially defining walls of the channel; the arm arrangement being radially movable with respect to the axis to vary the volume of the channel.

In an example embodiment, the pump further includes a biasing arrangement controlling radial motion of the arm arrangement.

In example implementations, the arm arrangement includes a first arm and a second arm; and the biasing arrangement includes a first spring member between the housing and the first arm; and a second spring member between the housing and the second arm.

The fluid inlet arrangement can include at least a pair of fluid inlets circumferentially spaced from each other and in communication with the channel; and the fluid outlet arrangement can include at least a pair of fluid outlets circumferentially spaced from each other and in communication with the channel.

In many examples, the first arm is an arced segment having a first end and second end; the first arm being radially adjustable relative to the impeller such that the second end moves radially more from the impeller than the first end; and the second arm is an arced segment having a first end and second end; the second arm being radially adjustable relative to the impeller such that the second arm second end moves radially more from the impeller than the second arm first end.

In another aspect, a regenerative pump is provided comprising an impeller rotatable about an impeller axis, the impeller including a first axial side and a second axial side, the impeller including a first plurality of regenerative pump vanes spaced about a circumference of the impeller at the first axial side of the impeller, the impeller also including a second plurality of regenerative pump vanes spaced about the circumference of the impeller at the second axial side of the impeller; and a pump housing in which the impeller is rotatably mounted, the pump housing defining an inlet and an outlet, the pump housing also defining a channel that extends circumferentially about the impeller between the inlet and the outlet, the channel including first and second regenerative flow sections respectively corresponding to the first and second pluralities of regenerative pump blades, the pump housing including an arm that defines at least a portion of the channel, the arm being moveable away from the impeller axis to enlarge a volume the channel and being moveable toward the impeller axis to reduce the volume of the channel.

In many implementations, the arm is moveable relative to the impeller axis between a first position and a second position, wherein the arm is closer to the impeller axis in the first position as compared to the second position.

In some examples, when the arm is in the first position the first and second regenerative flow sections are positioned to cooperate with the first and second pluralities of regenerative pump vanes to generate regenerative circulatory flow in the channel from the inlet to the outlet during pumping, and wherein when the arm is in the second position at least portions of the first and second regenerative flow sections are spaced sufficiently far from the impeller that regenerative circulatory flow is inhibited along such portions during pumping.

In one or more embodiments, the housing includes main housing assembly, wherein the arm is pivotally connected to the main housing assembly adjacent the inlet at a pivot axis so as to be pivotally movable between the first and second positions, wherein the arm extends generally from the inlet to the outlet of the pump housing, and wherein the pivot axis is parallel to the impeller axis.

In examples, when the arm is in the first position the channel has a cross-sectional flow area that is constant as the channel extends from the inlet to the outlet, and wherein when the arm is in the second position the cross-sectional flow area of the channel enlarges as the channel extends from the inlet to the outlet.

In another aspect, a method for reducing pressure rise in a regenerative pump is provided. The method comprising: radially moving an arm arrangement away from an impeller to expand a volume of a channel holding a fluid.

In one example method, the step of radially moving the arm arrangement includes radially moving a first arm and second arm away from the impeller, the impeller being within a cavity in a housing and secured to a rotating shaft.

Many example methods further include a step of controlling radially motion of the first arm and second arm by using a first spring between the housing and the first arm, and a second spring between the housing and the second arm.

In another aspect, a regenerative pump is provided comprising: an impeller rotatable about an impeller axis, the impeller including a plurality of regenerative pump vanes spaced about a circumference of the impeller; a pump housing in which the impeller is rotatably mounted, the pump housing defining an inlet and an outlet, the pump housing also defining a channel that extends circumferentially about the impeller between the inlet and the outlet; and wherein the channel comprises a regenerative section and a pressure limiting section; each of the regenerative section and pressure limiting section having a length that varies responsive to an amount of pressure in the channel.

In one example aspect, the pump further includes an arm arrangement constructed and arranged to affect a size of the channel.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only and are not restrictive of the claimed invention.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

Figure 1:
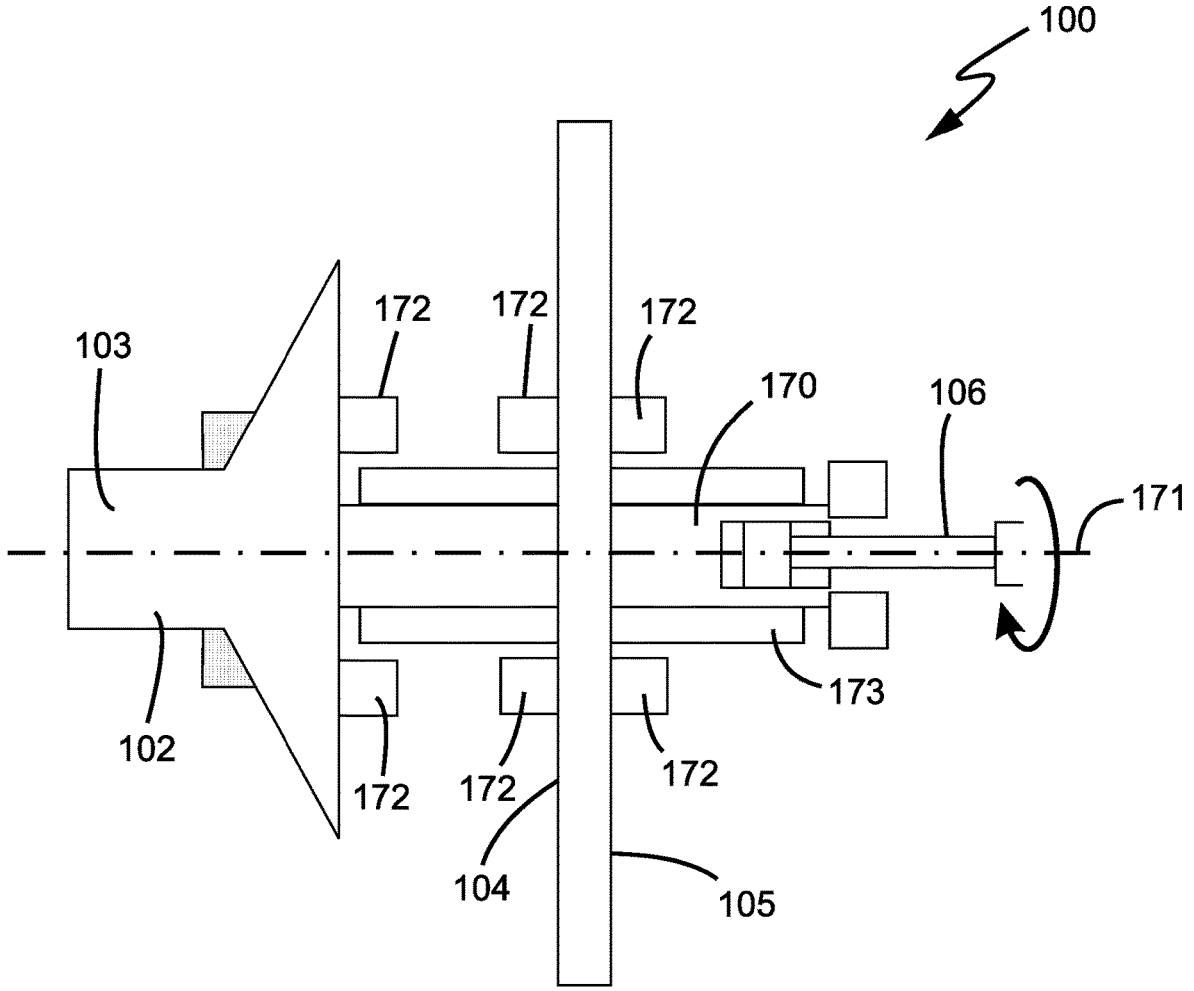
FIG. 1 is a schematic view of system including a centrifugal pump and a regenerative pump, constructed in accordance with principles of this disclosure, with only the impeller of the regenerative pump being depicted.

FIG. 1 shows a system 100 including a main stage pump 102 and a regenerative pump 104 that are both attached to a rotatable drive shaft 106 operationally coupled to an engine. In one non-limiting example, system 100 can be part of a fuel system for an aircraft engine. In this example, the engine rotates the drive shaft 106, which rotates the both pumps 102, 104 simultaneously. For example, the pumps 102, 104 can be sealingly mounted to a shaft 170 and isolated from each other via seals 172. The main stage pump 102 may be a centrifugal pump and include an inducer, an impeller, or both. In the example shown, an impeller 103 is illustrated. The regenerative pump 104 includes a regenerative pump impeller 105. Situated between the regenerative pump impeller 105 and the shaft 170 are thrust and journal bearings 173. FIG. 1 has omitted, for purposes of clarity, the housing of the regenerative pump 104.

Although regenerative pumps may be used in many types of systems, in this particular example for an aircraft engine, during start-up, fuel is made available to both the main stage pump 102 and the regenerative pump 104. The fuel pressure supplied to the engine is produced by the regenerative pump 104. When a predetermined engine speed is reached, the regenerative pump 104 is cut off from the fuel supply. The predetermined engine speed is selected so that the fuel pressure obtained from the main stage pump 102 is sufficient to operate the engine.

Figure 2:
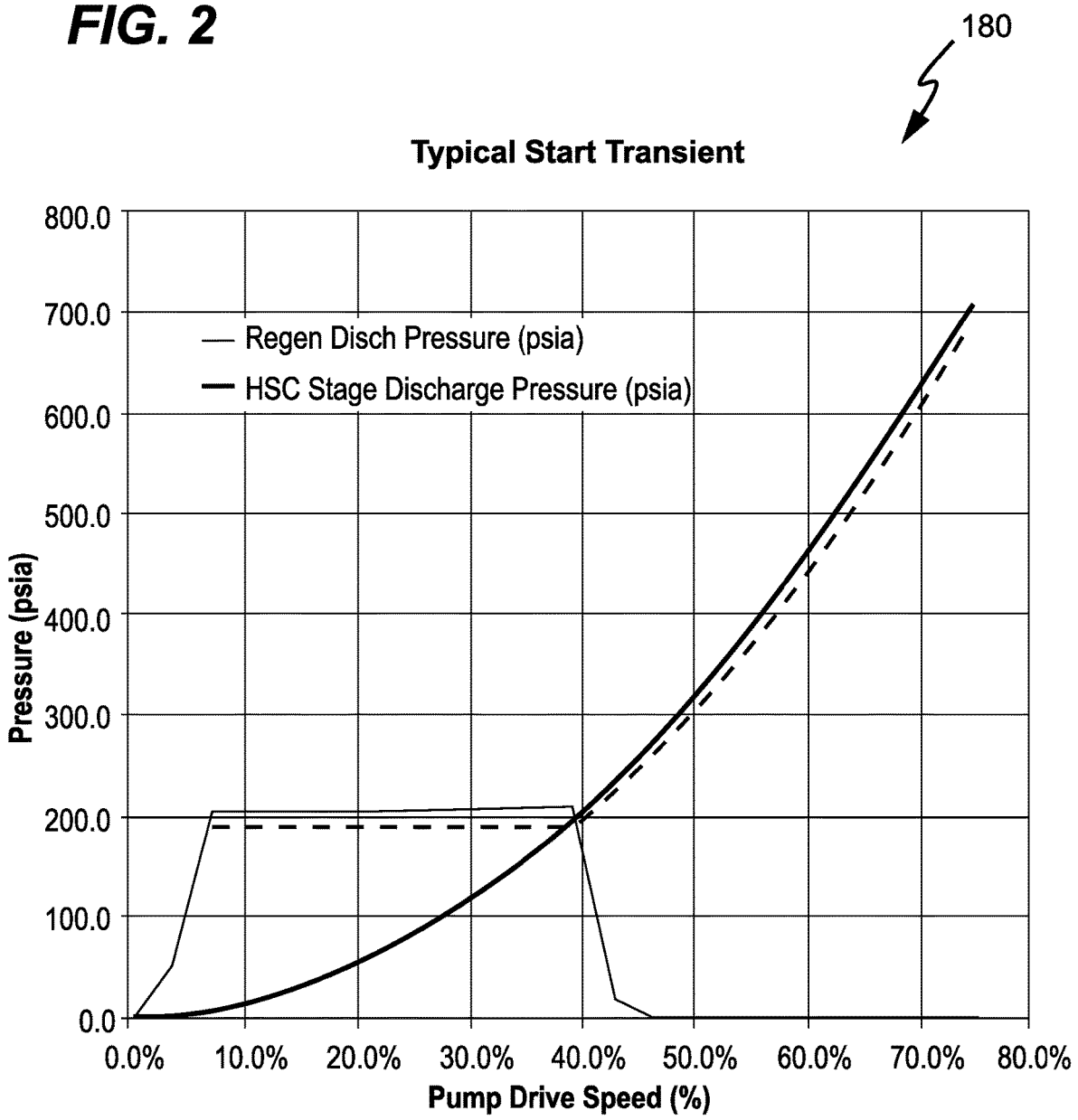
FIG. 2 is a graph showing how pump drive speed affects the outlet pressure of both a centrifugal pump and the regenerative pump of the example system of FIG. 1.

FIG. 2 illustrates a graph 180 of the outlet pressure of both the main stage pump 102 (labeled "HSC Stage Discharge Pressure (psia)") and the regenerative pump 104 (labeled "Regen Disch Pressure (psia)") against a percentage of the maximum rated pump drive speed at which the pumps 102, 104 are being driven. As shown, the regenerative pump 104 produces a much higher outlet pressure than the centrifugal pump 102 at low drive speeds (e.g., less than 10% of the maximum rated drive speed). As will be described herein, the system 100 is configured to limit the produced pressure at the outlet of the regenerative pump 104 as the pump drive speed increases.

Still in reference to FIG. 2, the regenerative pump 104 provides high fuel pressure even at low engine speeds. As the engine speed increases, the regenerative pump 104 provides higher and higher fuel pressure. Allowing the regenerative pump 104 to continue pumping an unrestricted amount of fuel at engine speeds beyond the predetermined engine speed would result in excessive pressure and torque, which could lead to failure of the fuel pump system 100. When the outlet pressure of the regenerative pump 104 reaches a predetermined level, it is desirable to limit the pressure generated by the regenerative pump 104. FIGS. 3-11 show an implementation for doing this.

Figure 3:
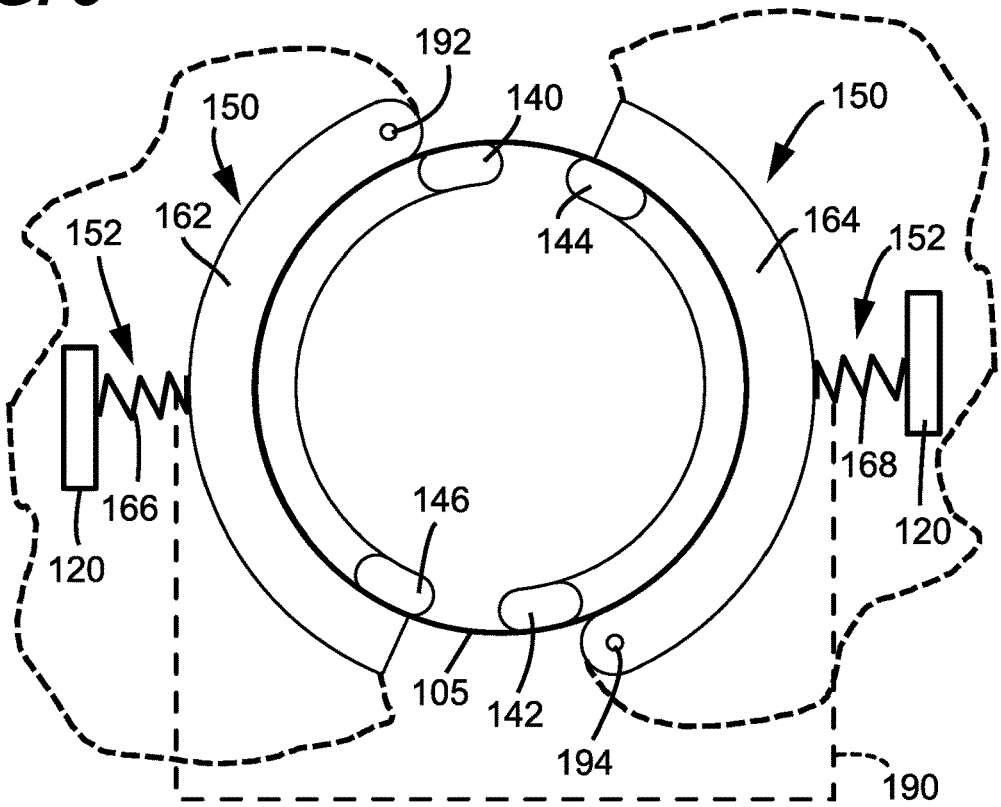
FIG. 3 is a schematic front view of the regenerative pump of FIG. 1, shown in a normal regenerative position.
Figure 4:
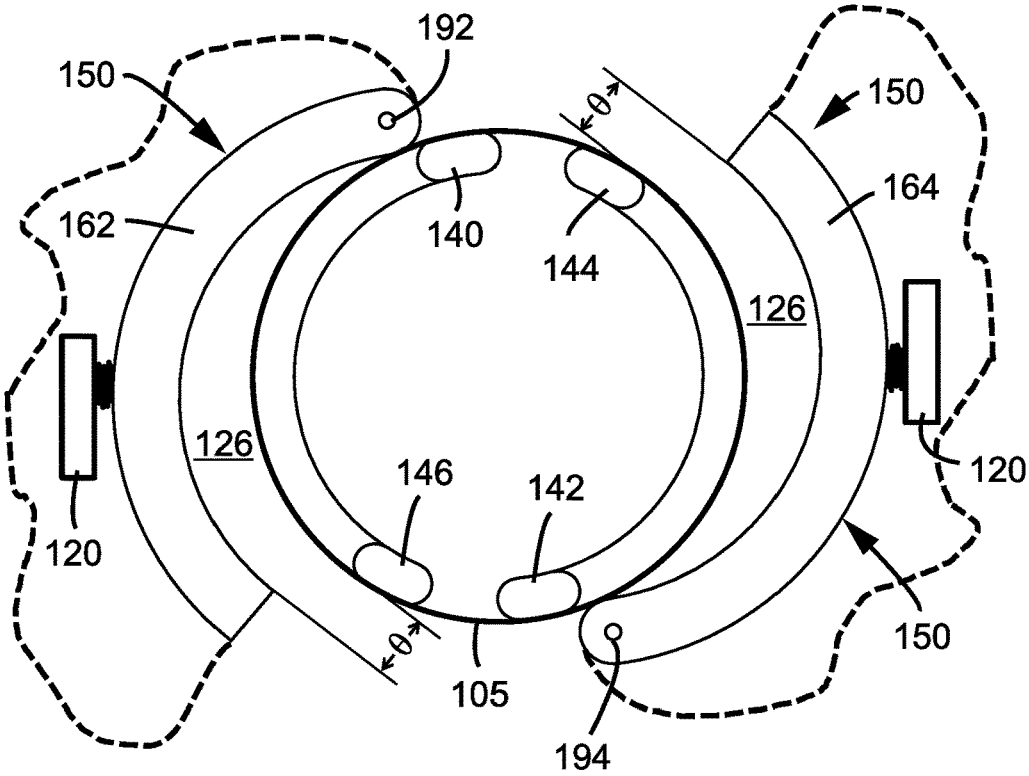
FIG. 4 is a schematic end view of the regenerative pump of FIG. 1, similar to FIG. 3, but shown in a pressure limiting position.

In reference now to FIGS. 3 and 4, an example embodiment of regenerative pump 104 is shown schematically. FIG. 3 illustrates the regenerative pump 104 in a normal regenerative operative position, while FIG. 4 illustrates the regenerative pump 104 in a pressure limiting position. By the term "normal regenerative", it is meant that regenerative flow occurs generally from the inlet to the outlet to maximize the amount of energy transferred to the fluid being conveyed through the pump. By the term "pressure limiting" position, regenerative flow is prevented along at least a portion of the pumping channel that extend circumferentially between the inlet and the outlet.

Figure 5:
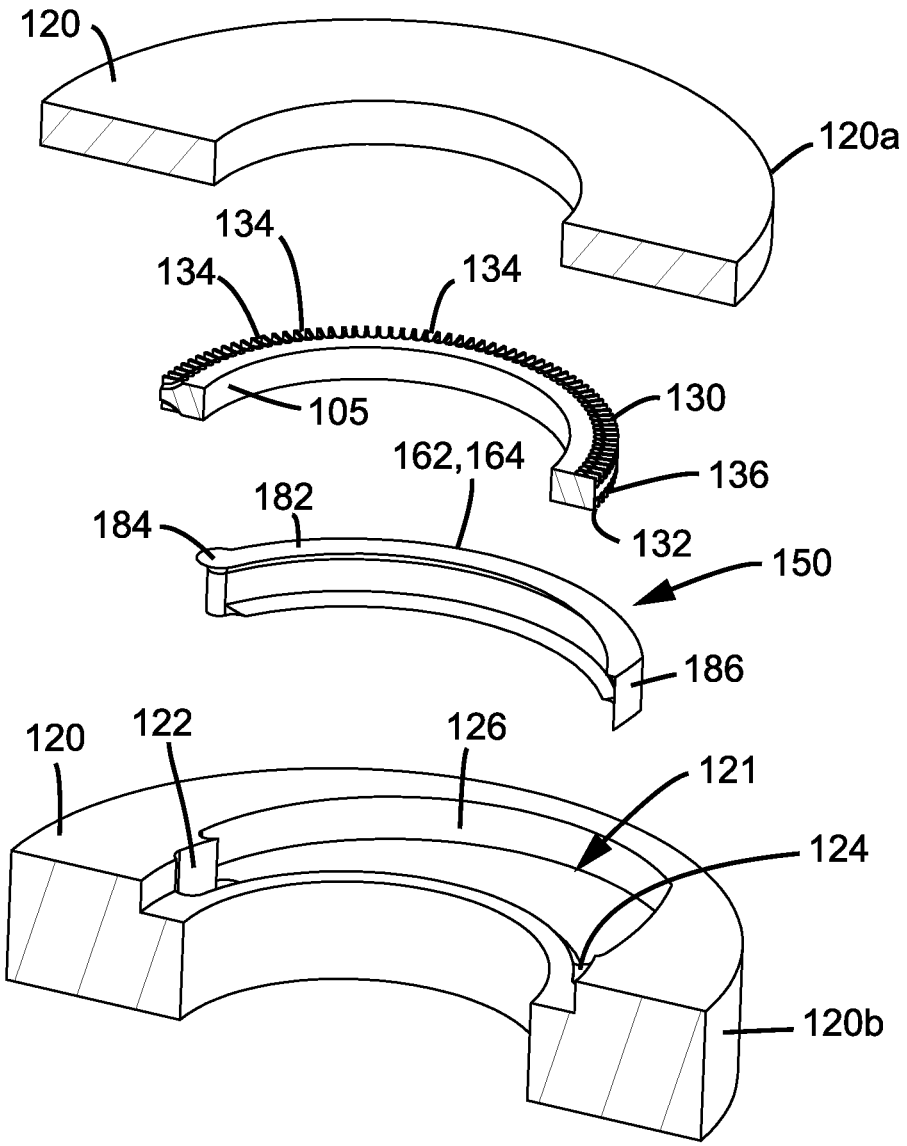
FIG. 5 is an exploded, perspective view of a portion of the regenerative pump of FIGS. 3 and 4.
Figure 6:
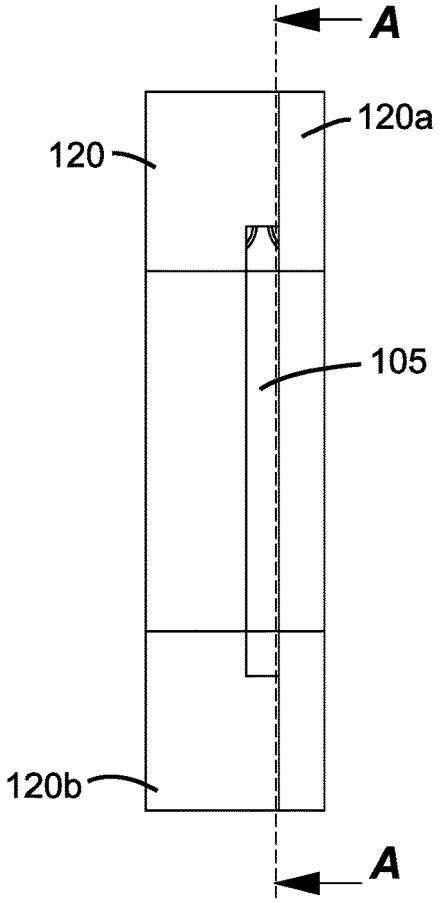
FIG. 6 is a side view of the regenerative pump of FIGS. 3 and 4.
Figure 7:
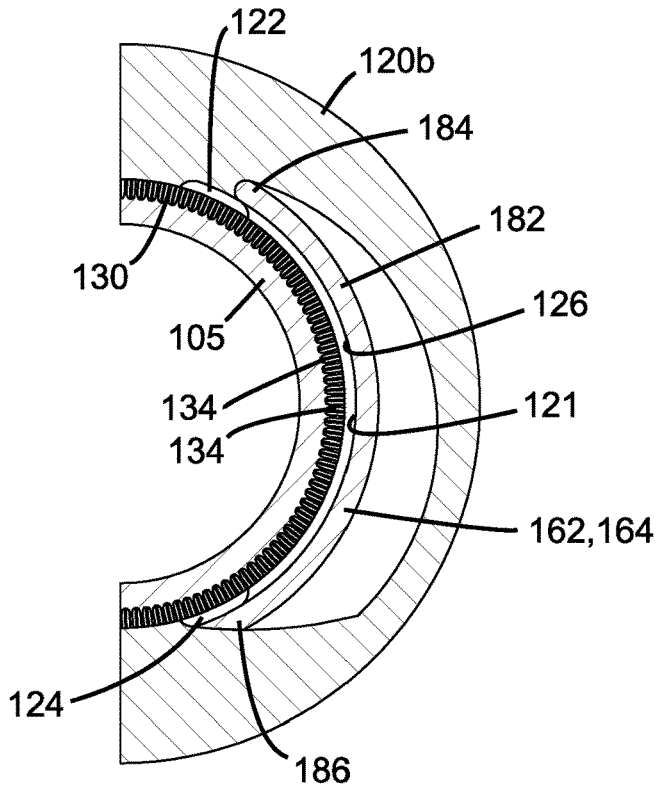
FIG. 7 is a cross-sectional view of the pump of FIG. 3, the cross-section being taken along the line A-A of FIG. 6; the pump being in the normal regenerative position.
Figure 8:
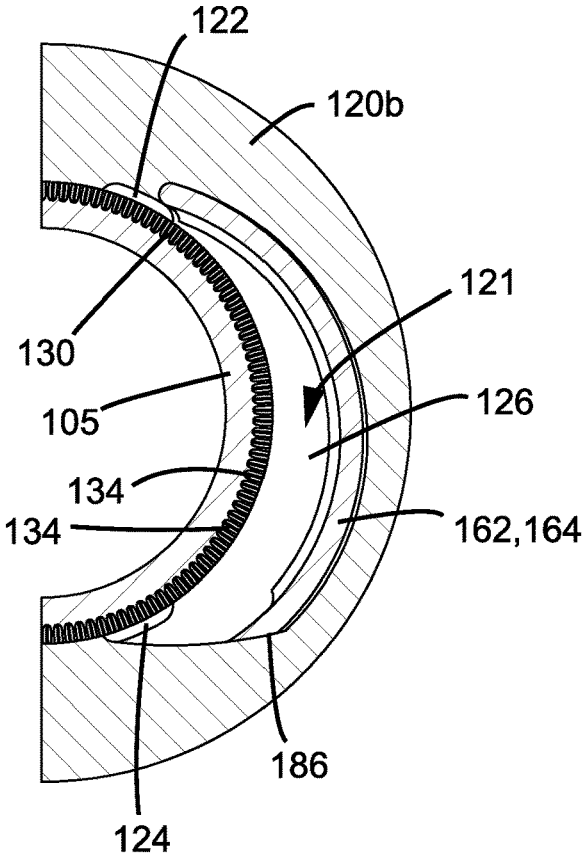
FIG. 8 is a cross-sectional view of the pump similar to FIG. 7, but showing the pump in the pressure limiting position of FIG. 4.

In reference now to FIGS. 3 and 5, the regenerative pump 104 includes housing 120. The housing 120 is shown in FIG. 5 in exploded, cross-section with first and second housing sections 120*a*, 120*b*. The housing 120 defines a cavity 121 having a fluid inlet arrangement 122 and a fluid outlet arrangement 124. A channel 126 defines an open volume extending between the fluid inlet arrangement 122 and a fluid outlet arrangement 124. The channel 126 extends circumferentially between the inlet arrangement 122 and the outlet arrangement 124.

In one example, when the pump 104 is operated in the pressure limiting state, regenerative flow occurs along a first portion of the pumping channel 126 and does not occur along a second portion of the pumping channel 126. The relative circumferential lengths of the first and second portions can vary to limit the output pressure of the pump 104. For example, as the rotational speed of the pump 104 increases above a rotational speed correspond to a pressure limit of the pump 104, the circumferential length of the first portion can decrease, and the circumferential length of the second portion can increase. In one example, the first portion can extend circumferentially from the inlet arrangement 122 to an intermediate location between the inlet arrangement 122 and the outlet arrangement 124, and the second portion can extend circumferentially from the intermediate location to the outlet arrangement 124.

The inlet arrangement 122 and fluid outlet arrangement 124 can take many forms. In the embodiment shown in FIG. 3, the inlet arrangement 122 includes a pair of fluid inlets 140, 142 circumferentially spaced from each other and in communication with the channel 126. The outlet arrangement 124 includes a pair of fluid outlets 144, 146 circumferentially spaced from each other and in communication with the channel 126.

Referring again to FIG. 1, the regenerative pump 104 includes the rotatable shaft 170, which extends into the housing 120. The rotatable shaft 170 has a longitudinal axis 171 (FIG. 1). The impeller 105 is mounted to the shaft 170 and within the cavity 121 (FIG. 5) of the housing 120 and rotates about the axis 171.

In FIG. 5, it can be seen how the impeller 105 includes a first axial side 130 and a second axial side 132. Spaced about a circumference of the impeller 105 from the first axial side 130 is a first plurality of regenerative pump vanes 134. Similarly, along the second axial side 132 are circumferentially positioned second plurality of regenerative pump vanes 136. The first vanes 134 and second vanes 136 are generally positioned at an angle relative to the central axis 171 and open into the channel 126.

Figure 10:
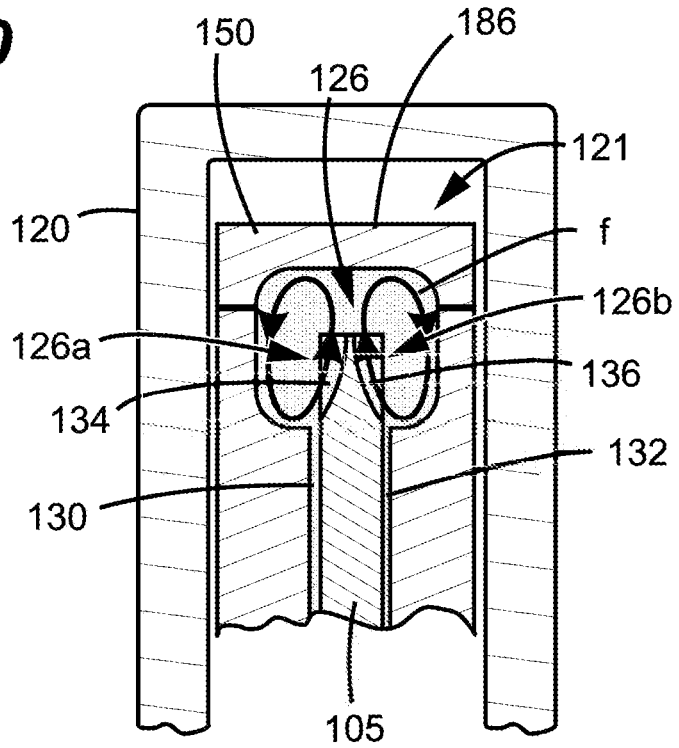
FIG. 10. is a schematic, cross-sectional view of a portion of the pump of FIG. 7, in a normal regenerative position adjacent to the outlet of the pump housing.

The channel 126 includes first and second regenerative flow sections 126*a*, 126*b* (FIGS. 10 and 11) respectively corresponding to the first and second pluralities of regenerative pump blades 134, 136. As can be seen in FIG. 10, each of the first and second regenerative flow sections 126*a*, 126*b* has a rounded cross-sectional profile. The first and second pluralities of regenerative pump vanes 134, 136 regenerate regenerative circulatory flow in the channel 126 from the inlet 140, 142 to the outlet 144, 146 during pumping in the normal regenerative state. In general, fluid delivered to the regenerative pump 104, such as fuel, enters the housing 120 through the inlets 140, 142. From there, the fluid flows along the vanes 134, 136 of the impeller 105, while the channel 126 is shaped (e.g., rounded, see FIG. 10) to deflect the fluid in the channel 126 back towards the inside diameter of the impeller vanes 134, 136. The fluid is recirculated (regenerated) to a lower point on the diameter. As the fuel flows along the vanes and within the channel 126, the pressure builds and expels the fluid out of the outlets 144, 146.

Figure 11:
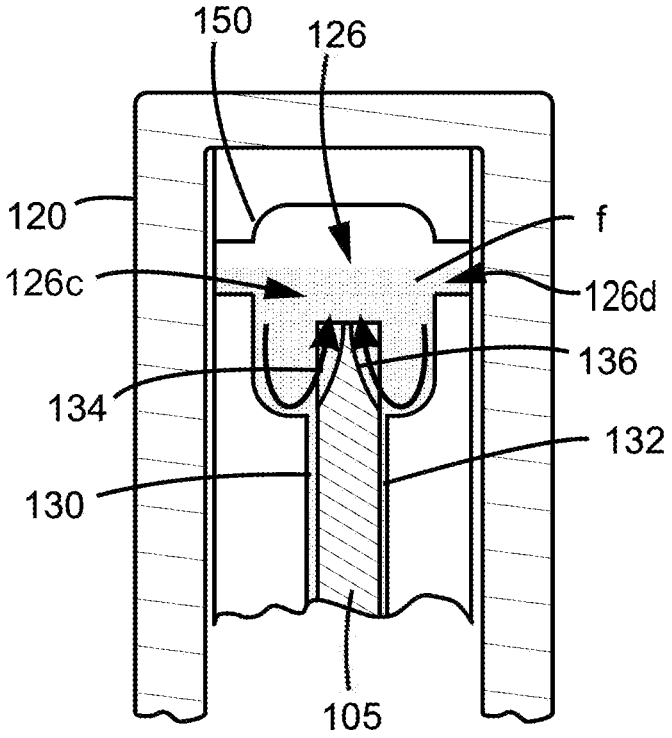
FIG. 11 is a schematic, cross-sectional view of a portion of the pump of FIG. 8, in a pressure limiting position adjacent to the outlet of the pump housing.

To limit the pressure rise in the pump 104, an arm arrangement 150 is provided. The arm arrangement 150 at least partially defines walls of the channel 126. The arm arrangement 150 is radially movable with respect to the axis 171 to vary the volume of the channel 126. In FIG. 3, the arm arrangement 150 is shown in the normal regenerative position, while in FIG. 4, the arm arrangement 150 is shown in the pressure limiting position. By comparing FIG. 3/FIG. 10 with FIG. 4/FIG. 11, the arm arrangement 150 is moved radially away from the impeller 105 to expand the volume of the channel 126 holding the fluid. By expanding the volume, this limits the amount of pressure generated by the pump 104. In FIG. 11, it can be seen how the fluid within the first and second regenerative flow sections 126*a*, 126*b* is slowed down to become pressure limiting sections 126*c*, 126*d*, as compared to FIG. 10, due to the larger volume in FIG. 11.

The arm arrangement 150 may be implemented in many different forms. In the embodiment shown, the arm arrangement 150 includes a first arm 162 and a second arm 164. A biasing arrangement 152 to control the radial motion of the arm arrangement 150 can be provided as a first spring member 166 between the housing 120 and the first arm 162 and a second spring member 168 between the housing 120 and the second arm 164.

FIGS. 5 and 7-9 show one of the arms, which is representative of both the first arm 162 and second arm 164. It can be seen, each arm 162, 164 is an arched segment 182 having a first end 184 and second end 186. The arm 162, 164 is radially adjustable relative to the impeller 105 such that the second end 186 moves radially more from the impeller 105 than the first end 184. When the second end 186 moves away from the impeller 105, this enlarges the volume of the channel 126. When the second end 186 moves toward the impeller 105, this reduces the volume of the channel 126. When the volume of the channel 126 is enlarged, the pressure limits, and when the volume contracts, the pressure that can be generated by the pump 104 increases.

Figure 9:
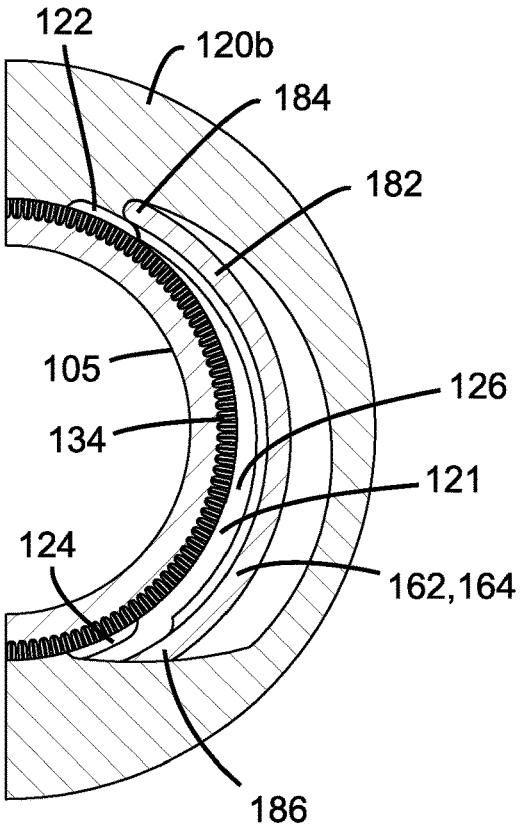
FIG. 9 is a cross-sectional view of the pump similar to FIGS. 7 and 8, but showing the pump in a partially pressure limiting position, between the position of FIG. 7 and FIG. 8.

In the non-limiting example shown (FIGS. 3 & 7), each of the arms 162, 164 is pivotably connected to the housing 120 adjacent the inlets 140, 142 (FIGS. 3 and 4) at a pivot axis 192, 194. In this example embodiment, the pivot axis 192, 194 is generally parallel to the longitudinal axis 171. As such, the first arm 162 and second arm 164 are pivotably movable between first (or normal regenerative) and second (or pressure limiting) positions. When the arms 162, 164 are in the first position (FIGS. 3 & 7), the first and second regenerative flow sections along the channel 126 are positioned to cooperate with the first and second pluralities of regenerative pump vanes 134, 136 to generate regenerative circulatory flow in the channel 126 from the inlet 140, 142 to the outlet 144, 146 during pumping. When the arms 162, 164 are in the second position (FIGS. 4 & 8), at least portions of the first and second regenerative flow sections in the channel 126 are spaced sufficiently far from the impeller 105 that regenerative circulatory flow is inhibited along such portions during pumping. FIG. 9 shows an intermediate position, between the first and second positions. In the intermediate position, the arms 162, 164 are partially spaced from the impeller 105, enlarging the volume of the channel 126 to result in limited pump pressure.

The above can be used in a method for reducing pressure rise in the regenerative pump 104. The method includes radially moving the arm arrangement 150 away from the impeller 105 to expand the volume of the channel 121 holding a fluid.

The step of radially moving the arm arrangement 150 can include radially moving the first arm 162 and second arm 164 away from the impeller 105.

The method can further include a step of independently controlling radial motion of the first arm 162 and second arm 164 by using first spring 166 between the housing 120 and the first arm 162, and second spring 168 between the housing 120 and the second arm 164.

The method can further include a step of controlling radial motion of the first arm 162 and second arm 164 by using a linkage arrangement 190 (FIG. 3) between the arms 162, 164 to synchronize their movement as to balance the pressure limiting effects on both sides.

Inventive Aspects

Aspect 1. A regenerative pump comprising: (a) a housing defining a cavity having a fluid inlet arrangement and fluid outlet arrangement, and a channel having an open volume extending between the fluid inlet arrangement and the fluid outlet arrangement; (b) a rotatable shaft extending into the housing having a longitudinal axis; (c) an impeller mounted to the shaft within the cavity; the impeller having a plurality of vanes spaced circumferentially around the axis and opening into the channel; and (d) an arm arrangement at least partially defining walls of the channel; the arm arrangement being radially movable with respect to the axis to vary the volume of the channel.

Aspect 2. The pump of aspect 1 further including a biasing arrangement controlling radial motion of the arm arrangement.

Aspect 3. The pump of aspect 2 wherein: (a) the arm arrangement includes a first arm and a second arm; and (b) the biasing arrangement includes a first spring member between the housing and the first arm; and a second spring member between the housing and the second arm.

Aspect 4. The pump of aspect 1 wherein: (a) the arm arrangement includes a first arm and a second arm; and (b) a linkage arrangement between the first arm and second arm to synchronize movement of the first and second arms to balance pressure limiting effects.

Aspect 5. The pump aspect 1 wherein: (a) the fluid inlet arrangement includes at least a pair of fluid inlets circumferentially spaced from each other and in communication with the channel; and (b) the fluid outlet arrangement includes at least a pair of fluid outlets circumferentially spaced from each other and in communication with the channel.

Aspect 6. The pump of aspect 3 wherein: (a) the first arm is an arced segment having a first end and second ends; the first arm being radially adjustable relative to the impeller such that the second end moves radially more from the impeller than the first end; and (b) the second arm is an arced segment having a first end and second ends; the second arm being radially adjustable relative to the impeller such that the second arm second end moves radially more from the impeller than the second arm first end.

Aspect 7. A regenerative pump comprising: an impeller rotatable about an impeller axis, the impeller including a first axial side and a second axial side, the impeller including a first plurality of regenerative pump vanes spaced about a circumference of the impeller at the first axial side of the impeller, the impeller also including a second plurality of regenerative pump vanes spaced about the circumference of the impeller at the second axial side of the impeller; and a pump housing in which the impeller is rotatably mounted, the pump housing defining an inlet and an outlet, the pump housing also defining a channel that extends circumferentially about the impeller between the inlet and the outlet, the channel including first and second regenerative flow sections respectively corresponding to the first and second pluralities of regenerative pump blades, each of the first and second regenerative flow sections having a rounded cross-sectional profile, the pump housing including an arm that defines at least a portion of the channel, the arm being moveable away from the impeller axis to enlarge a volume the channel and being moveable toward the impeller axis to reduce the volume of the channel.

Aspect 8. The regenerative pump of aspect 7, wherein the arm is moveable relative to the impeller axis between a first position and a second position, wherein the arm is closer to the impeller axis in the first position as compared to the second position.

Aspect 9. The regenerative pump of aspect 8, wherein when the arm is in the first position the first and second regenerative flow sections are positioned to cooperate with the first and second pluralities of regenerative pump vanes to generate regenerative circulatory flow in the channel from the inlet to the outlet during pumping, and wherein when the arm is in the second position at least portions of the first and second regenerative flow sections are spaced sufficiently far from the impeller that regenerative circulatory flow is inhibited along such portions during pumping.

Aspect 10. The regenerative pump of aspect 8, wherein the housing includes main housing assembly, wherein the arm is pivotally connected to the main housing assembly adjacent the inlet at a pivot axis so as to be pivotally movable between the first and second positions, wherein the arm extends generally from the inlet to the outlet of the pump housing, and wherein the pivot axis is parallel to the impeller axis.

Aspect 11. The regenerative pump of aspect 8, wherein when the arm is in the first position the channel has a cross-sectional flow area that is constant as the channel extends from the inlet to the outlet, and wherein when the arm is in the second position the cross-sectional flow area of the channel enlarges as the channel extends from the inlet to the outlet.

Aspect 12. A method for reducing pressure rise in a regenerative pump; the method comprising: radially moving an arm arrangement away from an impeller to expand a volume of a channel holding a fluid.

Aspect 13. The method of aspect 12 wherein the step of radially moving the arm arrangement includes radially moving a first arm and second arm away from the impeller, the impeller being within a cavity in a housing and secured to a rotating shaft.

Aspect 14. The method of aspect 13 further including a step of controlling radially motion of the first arm and second arm by using a first spring between the housing and the first arm, and a second spring between the housing and the second arm.

Aspect 15. The method of aspect 13 further including a step of synchronizing movement between the first arm and second arm to balance a pressure limiting effect on two sides of the impeller.

Aspect 16. The method of aspect 15 wherein the step of synchronizing movement includes using a linkage arrangement between the first arm and second arm.

Aspect 17. A regenerative pump comprising: an impeller rotatable about an impeller axis, the impeller including a plurality of regenerative pump vanes spaced about a circumference of the impeller; a pump housing in which the impeller is rotatably mounted, the pump housing defining an inlet and an outlet, the pump housing also defining a channel that extends circumferentially about the impeller between the inlet and the outlet; and wherein the channel comprises a regenerative section and a pressure limiting section; each of the regenerative section and pressure limiting section having a length that varies responsive to an amount of pressure in the channel.

Aspect 18. The regenerative pump of aspect 17 further including an arm arrangement constructed and arranged to affect a size of the channel.

The above represents example principles. Many embodiments can be made using these principles.

What is claimed is:

1. A regenerative pump comprising:

a housing defining a cavity having a fluid inlet arrangement and fluid outlet arrangement, and a channel having an open volume extending between the fluid inlet arrangement and the fluid outlet arrangement;

a rotatable shaft extending into the housing having a longitudinal axis;

an impeller mounted to the shaft within the cavity; the impeller having a plurality of vanes spaced circumferentially around the axis and opening into the channel; and an arm arrangement including a wall that partially bounds the channel, the wall defining a groove that faces the impeller; the arm arrangement being radially movable with respect to the axis to vary the volume of the channel.

2. The pump of claim 1 further including a spring arrangement controlling radial motion of the arm arrangement.

3. The pump of claim 2 wherein:

the arm arrangement includes a first arm and a second arm; and the spring arrangement includes a first spring member between the housing and the first arm; and a second spring member between the housing and the second arm.

4. The pump of claim 1 wherein:

the arm arrangement includes a first arm and a second arm; and a linkage arrangement between the first arm and the second arm to synchronize movement of the first and second arms to balance pressure limiting effects.

5. The pump claim 1 wherein:

the fluid inlet arrangement includes at least a pair of fluid inlets circumferentially spaced from each other and in communication with the channel; and the fluid outlet arrangement includes at least a pair of fluid outlets circumferentially spaced from each other and in communication with the channel.

6. The pump of claim 3 wherein:

the first arm is an arced segment having a first end and a second end; the first arm being radially adjustable relative to the impeller such that the second end moves radially more from the impeller than the first end; and the second arm is an arced segment having a first end and a second end; the second arm being radially adjustable relative to the impeller such that the second end moves radially more from the impeller than the second arm first end.

7. A regenerative pump comprising:

an impeller rotatable about an impeller axis, the impeller including a first axial side and a second axial side, the impeller including a first plurality of regenerative pump vanes spaced about a circumference of the impeller at the first axial side of the impeller, the impeller also including a second plurality of regenerative pump vanes spaced about the circumference of the impeller at the second axial side of the impeller; and a pump housing in which the impeller is rotatably mounted, the pump housing defining an inlet and an outlet, the pump housing also defining a channel that extends circumferentially about the impeller between the inlet and the outlet, the channel including first and second regenerative flow sections respectively corresponding to the first and second pluralities of regenerative pump vanes, each of the first and second regenerative flow sections having a rounded cross-sectional profile, the pump housing including an arm that defines at least a portion of the channel, the arm opposing the circumference of the impeller, the arm being moveable away from the impeller axis to enlarge a volume of the channel and being moveable toward the impeller axis to reduce the volume of the channel.

8. The regenerative pump of claim 7, wherein the arm is moveable relative to the impeller axis between a first position and a second position, wherein the arm is closer to the impeller axis in the first position as compared to the second position.

9. The regenerative pump of claim 8, wherein when the arm is in the first position the first and second regenerative flow sections are positioned to cooperate with the first and second pluralities of regenerative pump vanes to generate regenerative circulatory flow in the channel from the inlet to the outlet during pumping, and wherein when the arm is in the second position at least portions of the first and second regenerative flow sections are spaced sufficiently far from the impeller that regenerative circulatory flow is inhibited along such portions during pumping.

10. The regenerative pump of claim 8, wherein the housing includes main housing assembly, wherein the arm is pivotally connected to the main housing assembly adjacent the inlet at a pivot axis so as to be pivotally movable between the first and second positions, wherein the arm extends generally from the inlet to the outlet of the pump housing, and wherein the pivot axis is parallel to the impeller axis.

11. The regenerative pump of claim 8, wherein when the arm is in the first position the channel has a cross-sectional flow area that is constant as the channel extends from the inlet to the outlet, and wherein when the arm is in the second position the cross-sectional flow area of the channel enlarges as the channel extends from the inlet to the outlet.

12. A regenerative pump comprising:

an impeller rotatable about an impeller axis, the impeller including a first plurality of regenerative pump vanes spaced about a circumference of the impeller at a first axial side of the impeller, the impeller also including a second plurality of regenerative pump vanes spaced about a circumference of the impeller at a second axial side of the impeller;

a pump housing in which the impeller is rotatably mounted, the pump housing defining an inlet and an outlet, the pump housing also defining a channel that extends circumferentially about the impeller between the inlet and the outlet; and wherein the channel comprises a regenerative section and a pressure limiting section; each of the regenerative section and the pressure limiting section having a length that varies responsive to an amount of pressure in the channel; wherein the regenerative section of the channel deflects fluid towards the regenerative pump vanes and wherein the pressure limiting section of the channel has an expanded size compared to the regenerative section of the channel; wherein the regenerative pump includes an arm arrangement having a wall that partially bounds the channel, wherein the wall defines a groove that faces the impeller, and wherein the arm arrangement is radially movable with respect to the impeller axis to vary a volume of the channel.

13. The regenerative pump of claim 12, wherein the arm arrangement is arranged to pivotally move relative to the impeller to affect a size of the channel.

14. The regenerative pump of claim 12, wherein the first and second pluralities of regenerative pump vanes are positioned at an angle relative to the impeller axis and open into the channel.

15. The regenerative pump of claim 12, wherein the channel includes first and second regenerative flow sections respectively corresponding to the first and second pluralities of regenerative pump vanes.

* * * * *